US009861203B2

(12) United States Patent
Alvarez et al.

(10) Patent No.: US 9,861,203 B2
(45) Date of Patent: Jan. 9, 2018

(54) SEAT ASSEMBLY FOR TASK-ORIENTED SEATING

(71) Applicant: A-dec, Inc., Newberg, OR (US)

(72) Inventors: Jason Alvarez, Portland, OR (US); Jonathan Wilson, Lake Oswego, OH (US); Rebekah Slyter, Newberg, OR (US); Kohler Johnson, Dundee, OR (US); Charles Stark, Tigard, OR (US); Brian E. Bonn, Portland, OR (US); Fred Kaas, Portland, OR (US); Aaron Ochsner, Nehalem, OR (US); Nathan Hadley, Hillsboro, OR (US)

(73) Assignee: A-dec, Inc., Newberg, OR (US)

( * ) Notice: Subject to any disclaimer, the term of this patent is extended or adjusted under 35 U.S.C. 154(b) by 114 days.

(21) Appl. No.: 14/639,959

(22) Filed: Mar. 5, 2015

(65) Prior Publication Data

US 2016/0255958 A1 Sep. 8, 2016

(51) Int. Cl.

| | |
|---|---|
| ***A47C 3/00*** | (2006.01) |
| ***A47C 7/02*** | (2006.01) |
| ***A47C 7/14*** | (2006.01) |
| ***A47C 9/00*** | (2006.01) |
| ***A47C 9/02*** | (2006.01) |

(Continued)

(52) U.S. Cl.

CPC ..... *A47C 7/14* (2013.01); *A47C 7/022* (2013.01); *A47C 7/20* (2013.01); *A47C 7/402* (2013.01); *A47C 9/002* (2013.01); *A47C 9/02* (2013.01); *A47C 1/023* (2013.01); *A47C 3/00* (2013.01);

(Continued)

(58) Field of Classification Search

CPC ..... A47C 7/022; A47C 1/023; A47C 3/00; A47C 7/024; A47C 7/14; A47C 7/00; A47C 9/002; A47C 9/00

USPC ..... 297/452.27, 452.26, 312, 201, 311, 314, 297/199, 258.1, 208, 233, 215.16

See application file for complete search history.

(56) References Cited

U.S. PATENT DOCUMENTS

| | | |
|---|---|---|
| 2,828,801 A | 4/1958 | Papst |
| 3,740,096 A | 6/1973 | Bridger |

(Continued)

FOREIGN PATENT DOCUMENTS

| | | |
|---|---|---|
| CH | 295616 | 1/1954 |
| DE | 102005014112 | 10/2005 |

(Continued)

OTHER PUBLICATIONS

A-dec, Inc., Specialty Seating for Robust Support, http://us.a-dec.com/en/~/media/Adec/Document%20Library/Product% 20Information/Sales%20Information/Fact%20Sheets/85607200.pdf (downloaded Jun. 4, 2015).

(Continued)

*Primary Examiner* — Chi Q Nguyen

(74) *Attorney, Agent, or Firm* — Klarquist Sparkman, LLP

(57) ABSTRACT

A seat assembly for task-oriented seating comprises a seat support and a seat coupled to the seat support. The seat is movable under load, such as from the user's weight and movements, relative to the seat support. The seat has a cushion molded over a supporting armature with multiple bias elements. The seat and seat support are configured to deflect by predetermined amounts at defined locations over an extent of the seat assembly. In this way, the seat assembly provides for a range of comfortable and effective positions (Continued)

for users engaged in different active motions and having different preferences and sizes.

20 Claims, 13 Drawing Sheets

(51) Int. Cl.

| | |
|---|---|
| ***A47C 7/40*** | (2006.01) |
| ***A47C 7/20*** | (2006.01) |
| *A47C 1/023* | (2006.01) |
| *A47C 7/00* | (2006.01) |

(52) U.S. Cl.
CPC ..... *A47C 7/00* (2013.01); *A47C 7/024* (2013.01); *A47C 9/00* (2013.01)

(56) References Cited

U.S. PATENT DOCUMENTS

| | | | | |
|---|---|---|---|---|
| 3,851,920 | A | 12/1974 | Harris et al. | |
| 4,522,447 | A | 6/1985 | Snyder et al. | |
| 4,552,404 | A | 11/1985 | Congleton | |
| 4,643,481 | A * | 2/1987 | Saloff | A61G 5/1043 297/452.25 |
| 5,067,772 | A | 11/1991 | Koa | |
| 5,564,144 | A * | 10/1996 | Weingartner | A47C 7/26 297/452.27 |
| 5,590,930 | A | 1/1997 | Glockl | |
| 5,630,648 | A | 5/1997 | Allard et al. | |
| 5,704,691 | A | 1/1998 | Olson | |
| 5,826,940 | A | 10/1998 | Hodgdon | |
| 5,871,258 | A | 2/1999 | Battey et al. | |
| 5,950,263 | A * | 9/1999 | Hanson | A47C 1/023 297/452.21 |
| 6,123,390 | A * | 9/2000 | Greenwald | A47C 7/022 297/344.12 |
| 6,595,586 | B2 | 7/2003 | Brightbill et al. | |
| 6,811,218 | B2 * | 11/2004 | Deimen | A47C 3/18 297/195.11 |
| 7,350,865 | B2 | 4/2008 | Pearse | |
| 7,416,253 | B2 * | 8/2008 | Kim | A47C 1/023 297/201 |
| 7,614,704 | B2 * | 11/2009 | Whelan | A47C 7/021 297/452.25 |
| 7,837,273 | B1 | 11/2010 | Ratza et al. | |
| 8,317,267 | B2 | 11/2012 | Wallace | |
| 8,398,166 | B2 * | 3/2013 | Lindsay | B29C 44/0461 297/216.1 |
| 8,696,059 | B2 | 4/2014 | Carmichael, IV | |
| 9,161,630 | B2 * | 10/2015 | Brncick | A47C 7/022 |
| 9,409,614 | B2 * | 8/2016 | Chang | B62J 1/04 |
| 2007/0102968 | A1 | 5/2007 | Pearse | |
| 2011/0101748 | A1 | 5/2011 | Goetz | |
| 2011/0304192 | A1 | 12/2011 | Augustat | |
| 2012/0068507 | A1 * | 3/2012 | Debevec | A47C 7/021 297/250.1 |
| 2013/0113253 | A1 | 5/2013 | Meyer et al. | |
| 2014/0239686 | A1 | 8/2014 | Christianson et al. | |

FOREIGN PATENT DOCUMENTS

| | | |
|---|---|---|
| EP | 2438883 | 7/2013 |
| EP | 2666663 | 11/2013 |
| EP | 2962603 | 1/2016 |
| WO | WO96/10937 | 4/1996 |
| WO | WO2012/175963 | 12/2012 |

OTHER PUBLICATIONS

Ahearn, Dr. David J., "Operator Seating: Support for Life," http://rgpdental.com/pdfs/ProperSeating.pdf (downloaded on Jun. 4, 2015).
Back Quality Ergonomics, CorrectSit™, http://www.bqe-usa.com/blobs/PDF2/090707_BQE_CorrectSit_MAIL_ENG_09.pdf (downloaded on Jun. 4, 2015).
Back Quality Ergonomics, Dynamic™, http://www.bqe-usa.com/blobs/PDF2/090707_BQE_Dynamic_MAIL_EN.pdf (downloaded on Jun. 4, 2015).
Back Quality Ergonomics, ErgoSolex™, http://www.bqe-usa.com/blobs/PDF2/090707_BQE_ErgoSolex_MAIL_ENG_09.pdf (downloaded on Jun. 4, 2015).
Back Quality Ergonomics, The Sciszor®, 2 pages (document not dated).
Belmont Equipment, Operatory Seating, Dental Seating, 2 pages (document marked 2001).
Belmont Equipment, Operatory Seating, Model 080 and Model 081, 2 pages (document marked 2007).
Belmont Equipment, Operatory Seating, Model 100 and Model 101, 2 pages (document marked 2008).
Boyd Industries, Doctor Assistant Seating, http://www.boydindustries.com/orthodontics/doctor-assistant-seating.php (downloaded Jun. 4, 2015).
Brewer Company, Dental Seating, 8 pages (document marked Sep. 2013).
Brewer Design, DynaCore Seating System, http://brewercompany.com/wp-content/uploads/2015/01/LIT-D-008_DynaCore-Brochure.pdf (downloaded Jun. 4, 2015).
Castellini, Stool C9, http://pdf.medicalexpo.com/pdf/castellini/stool-c9/71690-138078.html#open (downloaded Jun. 4, 2015).
CB Dental, Andy, 1 page (document not dated).
Crown Seating, Arm Brochure, https://nebula.wsimg.com/dfc8232417bfa3886dbe6b4311286776?AccessKeyId=AA76679BD814093F0D09&disposition=0&alloworigin=1 (downloaded Jun. 4, 2015).
Crown Seating, The napa line of Dental Stools, https://nebula.wsimg.com/acd9fba7f7aa3e8a18d3c9db2cf5d13c?AccessKeyId=AA76679BD814093F0D09&disposition=0&alloworigin=1 (downloaded Jun. 4, 2015).
DentalEZ Group, Elbow Support, http://dentalez.com/downloads/product-literature/cat_view/71-downloads/49-product-literature/87-dentalez-equipment (downloaded Jun. 4, 2015).
DentalEZ Group, ErgoSure™ Stools, http://www.dentalez.com/downloads/product-literature/cat_view/71-downloads/49-product-literature/87-dentalez-equipment (downloaded Jun. 4, 2015).
DentalEZ Group, ErgoSure™ Stools Manual, http://www.dentalez.com/products/dentalez/dental-stools/ergosure-stools/63-ergosure-stools-product-literature-photographs-manuals (downloaded Jun. 4, 2015).
Fedesa, Astral Stool, http://www.fedesa.com/en/tab/tab_1.php (downloaded on Jun. 4, 2015).
Forest Dental, Doctor's Deluxe 6126C,http://catalog.forestdental.com/chairs-stools/stools (downloaded Jun. 4, 2015).
KaVo, PHYSIO Evo, http://pdf.medicalexpo.com/pdf/kavo/physio-evo/70663-126121.html (downloaded Jun. 4, 2015).
KaVo, PHYSIO One, http://www.kavo.com/en/file/4702/download?token=EeWCNgzk (downloaded on Jun. 4, 2015).
Marus, Dental Stools, http://marus.com/dental-chairs/stools/ (downloaded Jun. 4, 2015).
Midmark, Seating, http://www.midmark.com/docs/default-source/marketing-collateral/007-0715-00.pdf?sfvrsn=2 (downloaded Jun. 4, 2015).
Pelton & Crane, Spirit Chairs, 5 pages (document marked May 2012).
Pelton & Crane, Stools, 1 page (document not dated).
Planmeca, Dental Stools, 2 pages (document not dated).
RGP Inc, Dental, http://rgpdental.com/dental (downloaded Jun. 4, 2015).
Royal Dental Group, A2150 Operator Stool, http://www.royaldentalgroup.com/pdfs/A2150.pdf (downloaded Jun. 4, 2015).
Royal Dental Group, A2160 Assistant Stool, http://www.royaldentalgroup.com/pdfs/A2160.pdf (downloaded Jun. 4, 2015).
Royal Dental Group, D2110 Operator Stool, http://www.royaldentalgroup.com/pdfs/D2110.pdf (downloaded Jun. 4, 2015).
Royal Dental Group, D2120 Assistant Stool, http://www.royaldentalgroup.com/pdfs/D2120.pdf (downloaded Jun. 4, 2015).

(56) References Cited

OTHER PUBLICATIONS

Royal Dental Group, RA2 Assistant Stool, http://www.royaldentalgroup.com/pdfs/RA2.pdf (downloaded Jun. 4, 2015).
Royal Dental Group, RA24 Assistant Stool, http://www.royaldentalgroup.com/pdfs/RA24.pdf (downloaded Jun. 4, 2015).
Royal Dental Group, RO2 Operator Stool, http://www.royaldentalgroup.com/pdfs/RO2.pdf (downloaded Jun. 4, 2015).
Royal Dental Group, RO44 Operator Stool, http;//www.royaldentalgroup.com/pdfs/RO44.pdf (downloaded Jun. 4, 2015).
Salli, MultiAdjuster, http://www.salli.com/print.asp?siteid=en&id=Salli_MultiAdjuster_2 (downloaded Dec. 10, 2015).
Salli, Surgeon, http://www.salli.com/print.asp?siteid=en&id=Salli_Surgeon_2 (downloaded Dec. 10, 2014).
Salli, Swing, http://www.salli.com/print.asp?siteid=en&id=Salli_Swing (downloaded Dec. 10, 2015).
Salli, SwingFit, http://www.salli.com/print.asp?siteid=en&id=Salli_SwingFit_2 (downloaded Dec. 10, 2014).
Salli, Twin, http://www.salli.com/print.asp?siteid=en&id=Salli_Twin (downloaded Dec. 10, 2014).
Scandex LLC, Classic, Series 400 w/ Relax-style arm supports, http://www.scandex.us/bjorn/default.aspx (downloaded Jun. 4, 2015).
Scandex LLC, Unisex, Series 600 w/ Dual Swing-arm Support SAD12, http://www.scandex.us/bjorn/default.aspx (downloaded Jun. 4, 2015).
Sirona, Carl—The All-Around Seat, http://www.sirona.com/en/products/treatment-centers/carl/?tab=390 (downloaded Jun. 4, 2015).
Sirona, Hugo—The Smart Stool for you Dental Practice, http://www.sirona.com/ecomaXL/files/A91100-M41-B116-01-7600.pdf& download=1 (downloaded Jun. 4, 2015).
Summit Dental Systems, Compare Products, Stool, http://www.summitdental.com/compare-products-view?type_1=stool (downloaded Jun. 4, 2015).
Tecnodent, Egg & Sting, http://www.tecnodent.com/nuovo/wp-content/uploads/2014/07/Catalogo-Egg-Sting-ENG-Copia-3.pdf (downloaded Jun. 4, 2015).
Tecnodent, Ergo Line, http://www.tecnodent.com/nuovo/wp-content/uploads/2014/07/Catalogo-Ergo-ENG-Copia-21.pdf (downloaded Jun. 4, 2015).
Tecnodent, Gel Line, http://www.tecnodent.com/nuovo/wp-content/uploads/2014/07/Catalogo-Pluto-Venus-EN.pdf (downloaded Jun. 4, 2015).
Valachi, Bethany S., "Operator Stools: How Selection and Adjustment Impact Your Health," http://www.denstistrytoday.com/ergonomics/1109 (Aug. 31, 2005).
Vitali, Estro, 2 pages (document not dated).
Extended Search Report for European Patent Application No. 16158702.7 (dated Sep. 22, 2016).

* cited by examiner

SEAT ASSEMBLY FOR TASK-ORIENTED SEATING

BACKGROUND

Task-oriented seating is particularly geared for users who actively move while they are seated. Some users adopt an active position where they are leaned forward so they are closer to their activities, such as their work. As one example, dental practitioners seek task-oriented seating that allows them to practice more effectively with greater comfort as they lean forward to access a patient's oral cavity. Similar considerations also apply in contexts outside of dentistry. Current seating options, however, do not provide sufficient support and comfort over long periods, especially considering users who need to ingress and egress from such seating repeatedly. Further, users range in shapes, sizes and their ways of using such seating, so organizations need task-oriented seating solutions that address these ranges without introducing undue expense and complexity into the work environment.

SUMMARY

Described below are embodiments of a seat assembly and an associated stool that address some of the drawbacks of conventional task-oriented seating.

According to one implementation, a seat assembly for task-oriented seating, such as a stool, comprises a seat support and a seat coupled to the seat support. The seat is movable under load from the user's weight and movements relative to the seat support. The seat has a cushion molded over a supporting armature with multiple bias elements. The seat and seat support are configured to deflect by predetermined amounts at defined locations across an extent of the seat assembly.

The seat can comprises a pommel area defined at a forward side of the seat and along a medial axis of the seat. The seat can comprise two thigh areas arranged on opposite sides of the medial axis, and the thigh areas can be configured to deflect more than other areas of the seat. The seat can comprise a rear area configured to support a user's posterior, and at least some of the multiple bias elements can be positioned in the rear area to be individually deflectable to support the user's ischial tuberosities.

The seat can be coupled to the seat support by multiple force absorbing mounts and/or force isolating mounts. The mounts can comprise resilient bushing members. The mounts can comprise threaded connections to the seat and to the seat support. The seat can be coupled to the seat support by at least one slide on the armature positioned to slidingly engage a ramp on the seat support. The slide can be positioned, when the seat is in use, to move laterally or vertically on the ramp relative to a medial axis of the seat, as well to rotate relative to one or both of two horizontal axes. The slide and the ramp can be positioned to control deflection of the seat in an area of the user's outer thigh.

In some implementations, the armature has a center rib positioned along a medial axis of the seat and a series of radially spaced shorter ribs on both sides of the center rib. In some implementations, the seat support has a generally triangular-shaped front edge.

The seat assembly can comprise an adjustment assembly for mounting to a lower surface of the seat support, wherein the adjustment assembly connects the seat to a leg assembly of the stool and to a seat back assembly.

In some implementations, a stool for task-oriented seating can comprise a leg assembly with multiple feet, a seat assembly comprising a seat and supported by the leg assembly and a height adjustable seat back coupled to the seat assembly. The seat assembly can comprises a seat and a seat support, and the seat and the seat support can be configured to deflect by varying predetermined amounts along a surface of the seat under load from a user.

The seat of the stool can comprise a pommel area defined at a forward side of the seat and along a medial axis of the seat, two thigh areas arranged on opposite sides of the medial axis adjoin the pommel area and a rear area extending across the seat and from a rear side toward the forward side. The rear area can comprise multiple bias elements that are individually deflectable to support the user's ischial tuberosities.

The pommel area of the seat can be configured to deflect less than the thigh areas and less than the rear area. The seat can be dynamically coupled to the seat support. The seat can coupled to the seat support by separate force absorbing and/or force isolating mounts. The seat can comprise a cushion and an armature to which the cushion is overmolded. The seat can be positionable in use such that a forward side of the seat is angled downwardly.

The foregoing and other features and advantages of the disclosed embodiments will become more apparent from the following detailed description, which proceeds with reference to the accompanying figures.

DETAILED DESCRIPTION

Described below are several implementations of a seat assembly for better task-oriented seating. The seat assembly provides greater comfort and effectiveness than conventional seating options. For example, the seating assembly has a seat strategically configured to relieve pressure under a user's thighs to reduce restrictions to the user's blood flow to reduce localized high pressure areas, which are chief complaints among users of task-oriented seating (including dentists and others who routinely undertake active tasks while in a seated position). In addition, the seat adapts to each different user's unique anatomical features (including, e.g., shapes, contours, aspect ratios, weights, etc.), as well as to different modes of use (including different positions, different preferences, etc.) in a way that creates a "custom fit" for the user by appropriately supporting the user simply through the user's contact with the seat.

Implementations of the seat have individually "tuned" areas each having a different stiffness and/or ability to deflect or yield under load. For example, anatomical areas known to respond positively to more "support" (e.g., the ischial tuberosities or "sit bones," as one example) are provided with such support, whereas those areas that respond positively to more freedom of movement (e.g., the thighs) are provided with such freedom, yet without a complete loss of support. Moreover, the seat can be configured to prevent the user from sliding forward when the user adopts an active position used in many tasks, typically with his feet touching the floor and leaning forward at the waist or hips. Overall, the advantages of the seat include one or more of support, security, comfort and a sense of well-being.

Representative Stool

Figure 1:
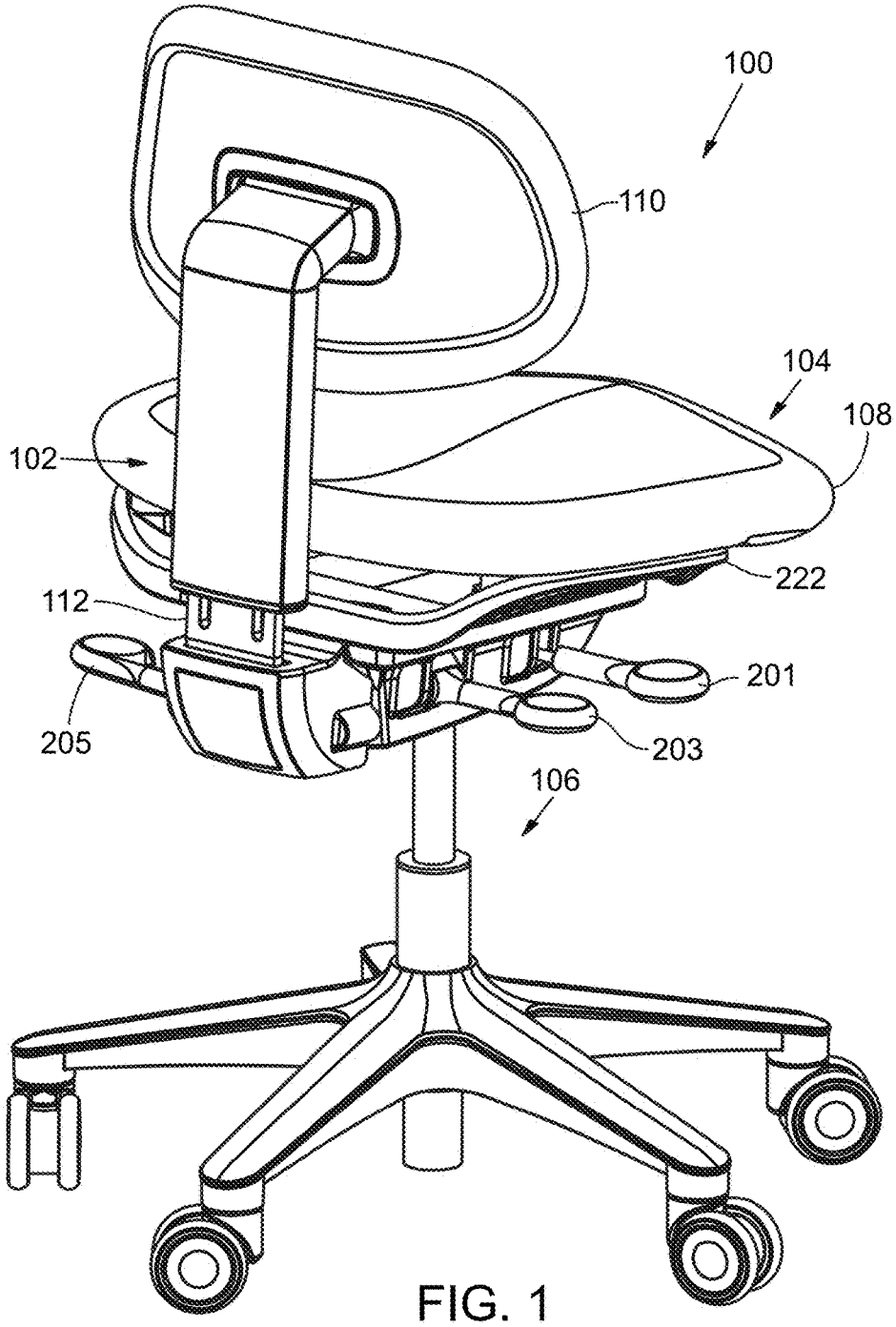
FIGS. 1 and 2 are perspective views of a stool according to a first implementation.
Figure 2:
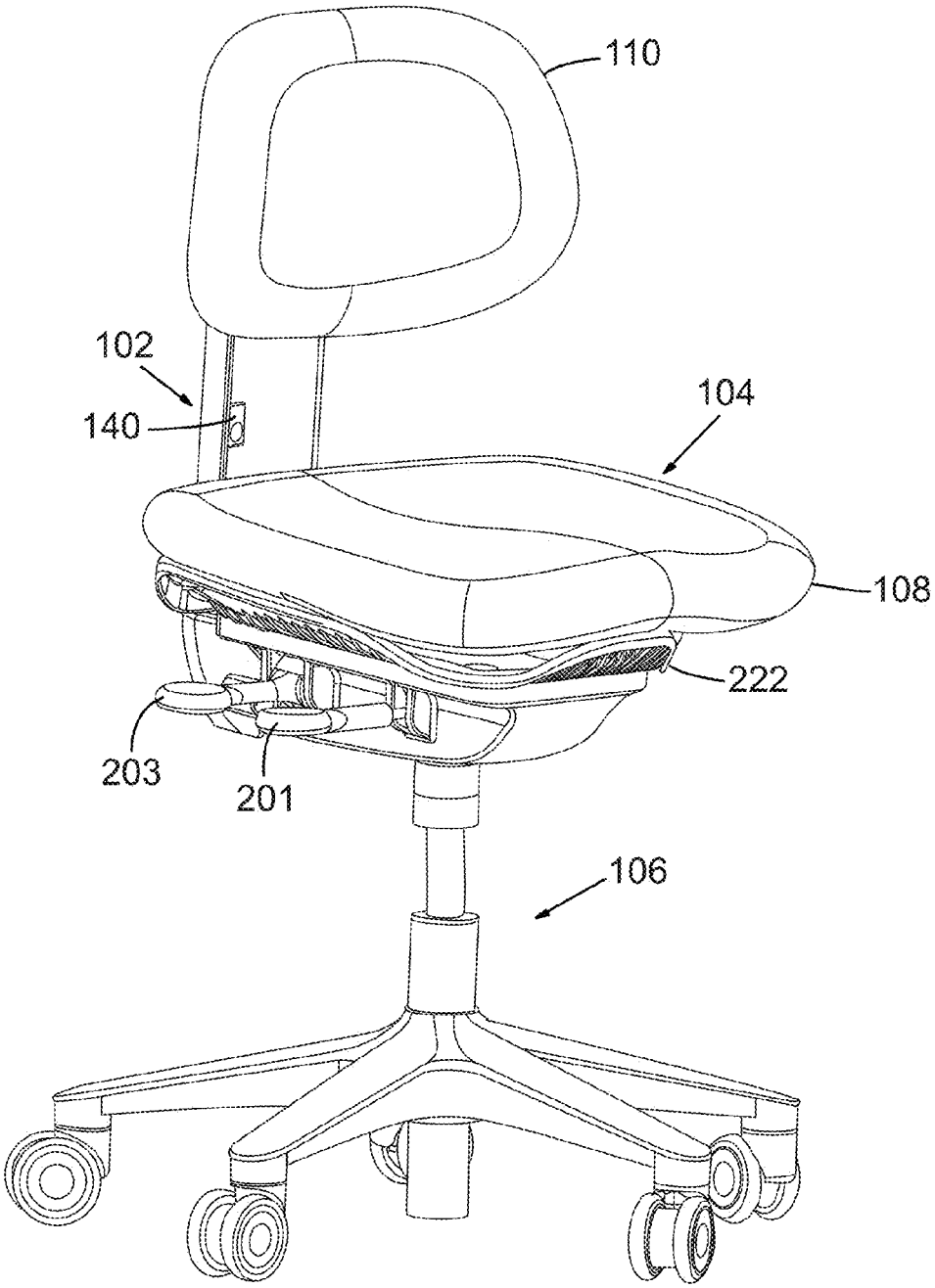

FIGS. 1 and 2 are perspective views from different sides of a representative stool 100 having a seat assembly 104 that provides at least some of the advantages discussed above. The stool 100 has a seat back assembly 102, which extends from the seat assembly 104. The seat back assembly 102 and the seat assembly 104 are supported by the leg assembly 106. As shown, the leg assembly 106 has a center support from which multiple legs with casters extend.

The seat assembly 104 includes a seat 108 shaped to support a range of users in different seated positions, as is discussed below in more detail. The seat back assembly 102 is adjustable to change a height of a seat back 110 coupled to its upper end, such as by using a pushbutton actuator 140 (FIG. 2). At a lower end, the seat back assembly 102 has a support 112 (also referred to as a support member) that is connected to a rear area of the seat assembly 104.

Seat Assembly

Figure 3:
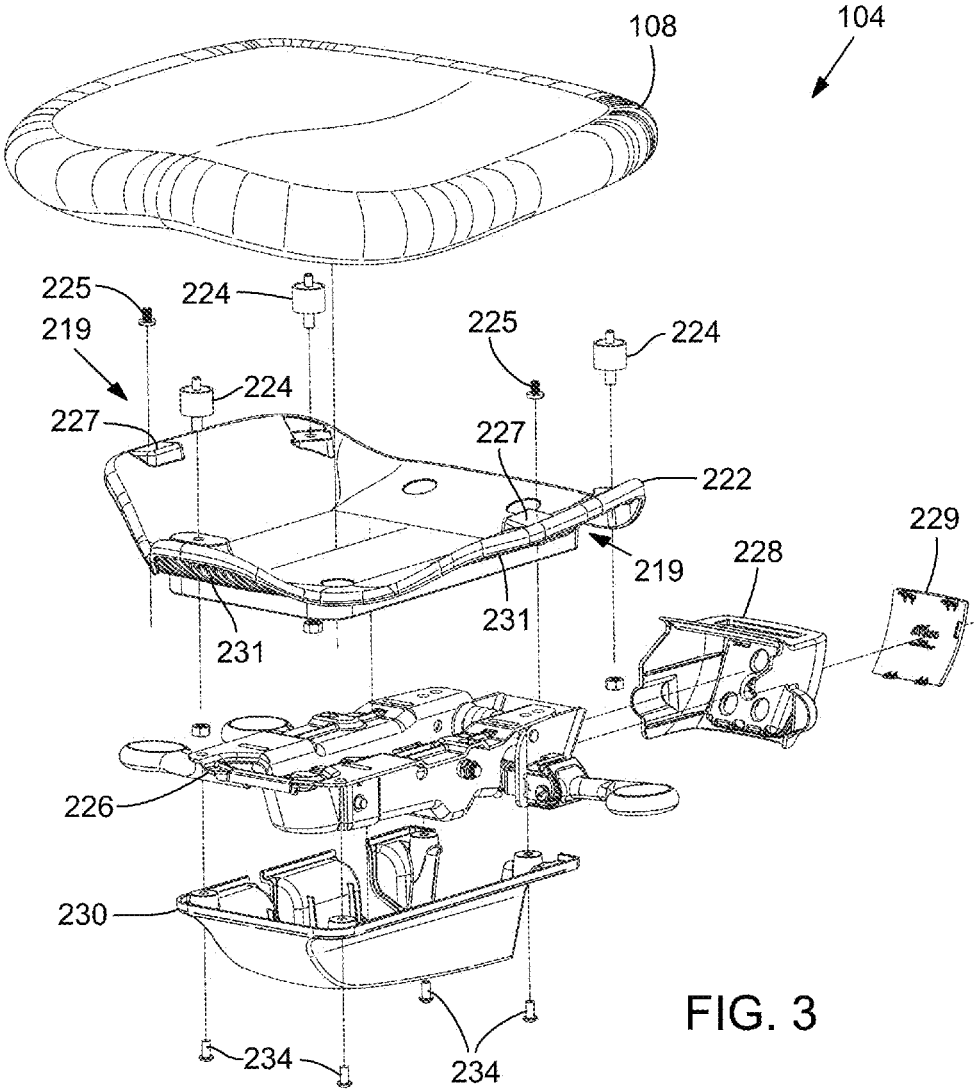
FIG. 3 is an exploded perspective view of a seat assembly of the stool of FIGS. 1 and 2.

Referring to FIG. 3, in addition to the seat 108, the seat assembly 104 comprises a seat support 222, an adjustment assembly 226, a rear cover 228, a rear plate 229, and a lower cover 230. The seat 108 comprises a supporting structure, referred to herein as an armature 240, a resilient cushion 242 and a cover 243, as shown in FIG. 4 and discussed in more detail below.

The seat 108 is coupled to the seat support 222 by mounts 224 at multiple locations, including a right rear location, a left rear location and a front center location. The mounts 224 each have upper and lower threaded extensions for attachment to the armature 240 above and to the seat support 222 below, respectively, that are joined by a surrounding bushing made of rubber or other resilient material. The rubber or other resilient material of the mounts 224 tends to absorb and/or isolate forces, and also allows for slight movements between the armature 240 and the seat support 222 in use.

Figure 4A:
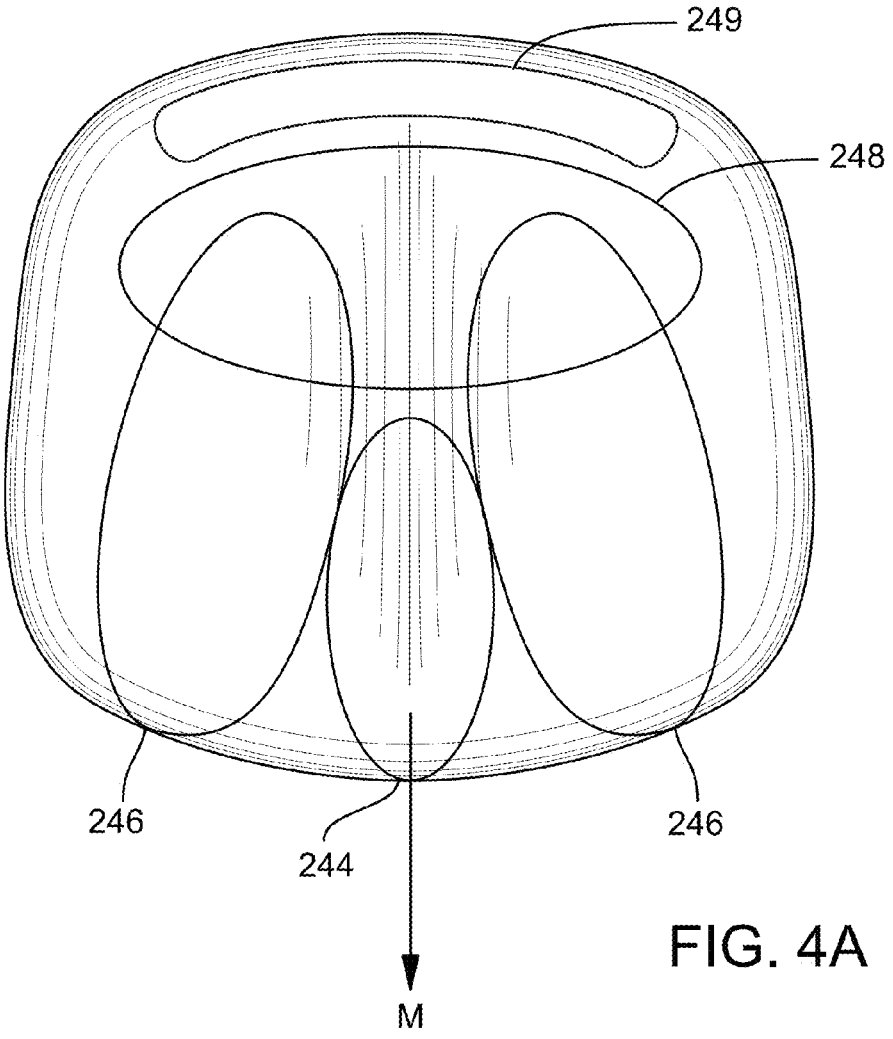
FIG. 4A is a schematic plan view of the seat of FIGS. 1-3 showing its different areas.

Referring to FIG. 4A, which shows a plan view of the seat assembly 104, several areas over its extent can be defined generally according to how they interface with a typical user. At the forward end of the seat 108, and aligned along a medial axis M, is a pommel area 244. The pommel area 244 is configured to prevent the user from sliding forward and out of the seat if it is tilted forward, and to provide sufficient support (see also FIG. 9). On either side of the pommel area 244, and extending from the forward end of the seat rearward to approximately its middle, and in some cases further rearward, are thigh areas 246 (the left thigh area is also labeled in FIG. 4B). The thigh areas 246 are designed to provide appropriate support to the user's thighs, including different levels of support at different areas. A rear area 248 is configured to support the user's posterior and in particular the ischial tuberosities or "sit bones." There can also be an outer rear area 249 that is configured to deform elastically less than the other areas because it not typically contacted by a user while the user is seated.

As shown, the various areas can overlap with each other. For example, the thigh areas 246 can overlap with the rear area 248 as shown. This is because the same user may sit farther forward or rearward depending upon his current seated activity (e.g., actively working vs. having a conversation), the duration in the position and numerous other factors. In addition, users of different sizes will sit on the seat in different positions, and thus the thigh areas for a user with shorter legs overall and shorter thighs may tend to sit more forwardly in the stool than a user with longer legs and longer thighs.

Referring again to FIG. 3, the seat support 222 can have a forward end shaped with a generally triangular nose with relieved areas defined on either side to provide sufficient space/relief for the seat 108 to deflect downward under load from a user's thighs in the thigh areas 246, which tends to relieve pressure on the thighs. The seat 108 is generally spaced apart above the seat support 222, except where the seat support 222 rises upward to the three mounts 224 and the additional side contact locations 219, which are discussed below in greater detail. The spacing between the seat 108 and the seat support 222 ensures that the seat 108 can deform sufficiently under load from a user without its resulting profile being interrupted by contact with the seat support 222, which can lead to a slightly less comfortable position for the user. In addition, the spacing provides clearance to compensate for dynamic movements, such as when a heavy user "plops down" during ingress. The seat support 222 can be configured to have ribbed areas 231 in one or more locations to provide increased strength without excess weight.

Figure 4B:
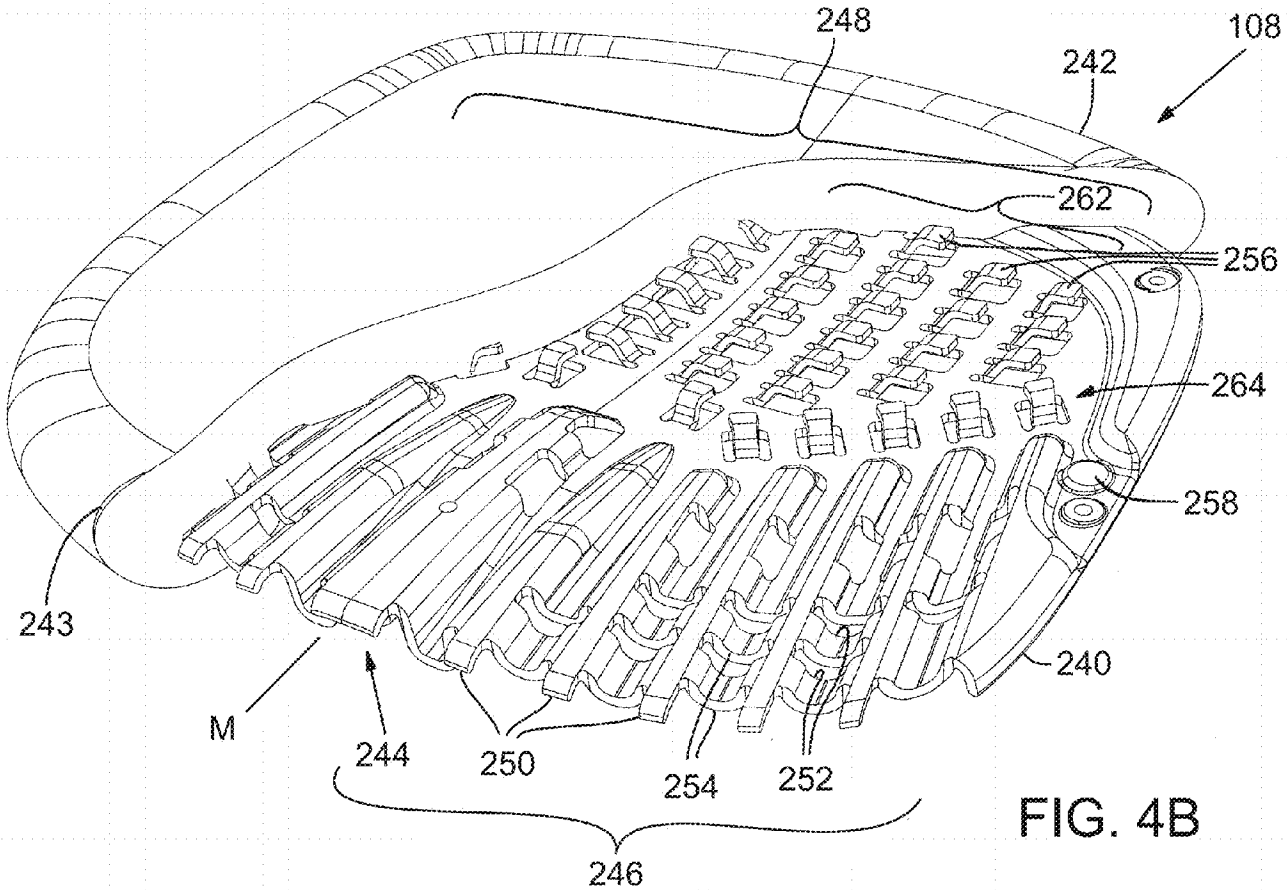
FIG. 4B is perspective view of the seat of FIGS. 1-3 with a portion cut away to show underlying supporting structure.

At side contact locations 219, the seat 108 is also coupled to the seat support 222 at its left and right sides by slides 225 on the armature 240 that can contact and slide along respective ramps 227 of the seat support 222. The ramps 227 extend in a lateral direction and slope downwardly in a direction towards the periphery of the seat support 222. In more detail, the action of the slides 225 under load on the seat 108 is to slide laterally inward (relative to the periphery of the seat support 222) along the respective ramps 227, rather than just simply rotating (like mounts 224), thus tending not to laterally compress the seating space and to cause uncomfortable pressure along the outer sides of the thighs. FIG. 4B shows a slide location 258 defined for the slide 225 on the left side. In one implementation, the slides 225 can be threaded nylon fasteners that are threaded into bores at the slide locations 258 from a lower side of the armature 240 and having smooth heads that can contact and slide along the ramps 227.

The seat cushion 242 can have a contoured top surface that rises and falls in a manner that mimics or complements the human anatomy of a seated user, and which provides an optimal pressure distribution, i.e., one that is supportive yet comfortable. The cover 243 generally, although not necessarily, constrains the seat cushion 242, which is made of a foam or other similar material, such that the contours of the cushion and contours of the cover are generally the same. The seat cushion 242 varies in thickness over its extent according to develop its predetermined contours, including those of its top surface. In addition to varying the thickness of the seat cushion 242 at different locations, it is also possible to vary the material(s) used at different locations.

Figure 7:
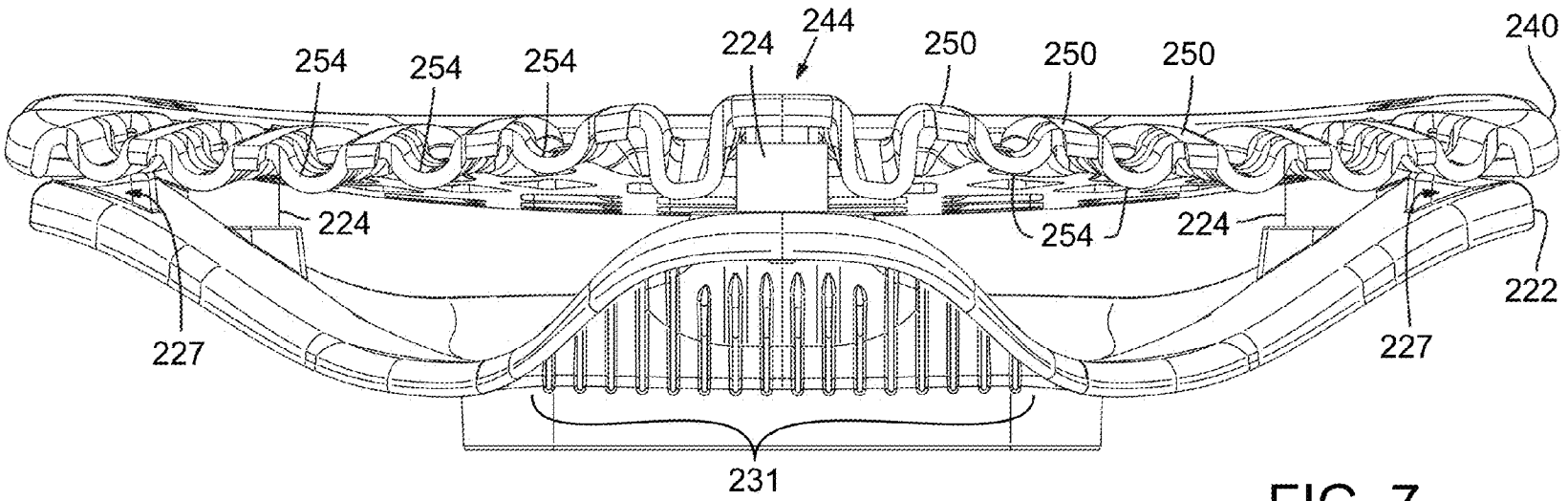
FIG. 7 is a front elevation view of an armature and a support of the seat.
Figure 8:
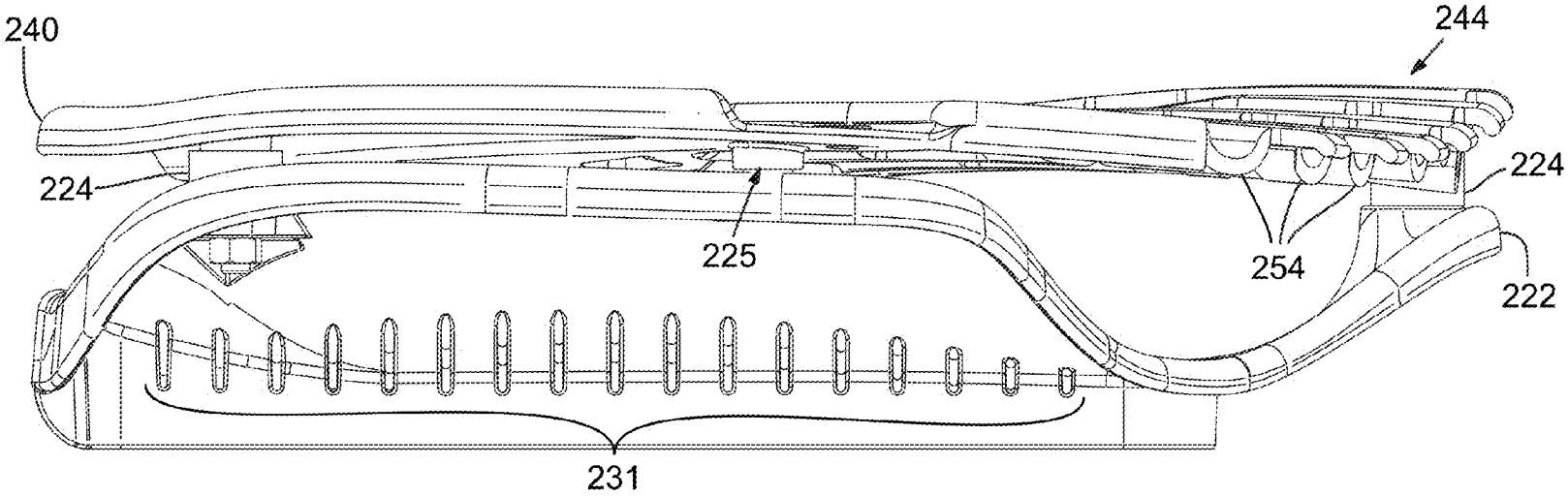
FIG. 8 is a side elevation view of the armature and the support of the seat.

The armature 240 can have a prevailing shape and contours similar but not necessarily identical to those of the cushion 242. Referring to FIG. 4B, in the illustrated implementation, the armature 240 has a series of ribs 250 that are spaced approximately radially in a fan-like appearance as they extend towards the forward edge of the seat 108. The pommel area 244 is defined by a central rib extending along the medial axis M, and multiple shorter and thinner ribs are arranged in the respective thigh areas 246 that adjoin the pommel area. In the illustrated implementation, adjacent ones of the ribs 250 are joined by connecting segments 254 that are curved (see also FIG. 7). In addition, at least some of the ribs 250 have through openings 252 defined therein along their lengths. Overall, the ribs 250 and their openings 252 are configured to provide a predetermined deformation or deflection under a defined load. In general, the pommel area 250 is configured to deflect less than the adjoining thigh areas 246, so the central rib is larger and has fewer through openings. Conversely, the ribs 250 of the thigh areas 246 have smaller cross sections and more through openings than the central rib.

In the rear area 248, the armature 240 is configured to have multiple bias elements 256 arranged in a pattern. In the illustrated implementation, the bias elements 256 in the rear area 248 are arranged in lines generally parallel to the medial axis M, with an angled line 264 of bias elements 256 arranged roughly between the bias elements 256 in the rear area 248 and the ribs 250 in the thigh areas 246. In the illustrated implementation, the bias elements 256 are independently deflectable elements, but it some implementations, it would also be possible to have small groups of such elements or similar structures that are joined together. In the illustrated implementation, the bias elements 256 in a left rear area 262 (which appears on the right in the figure) have free ends that point generally away from the medial axis M. Likewise, the bias elements in a right rear area on the other side of the medial axis M also have free ends that point generally away from the medial axis M.

Figure 5A:
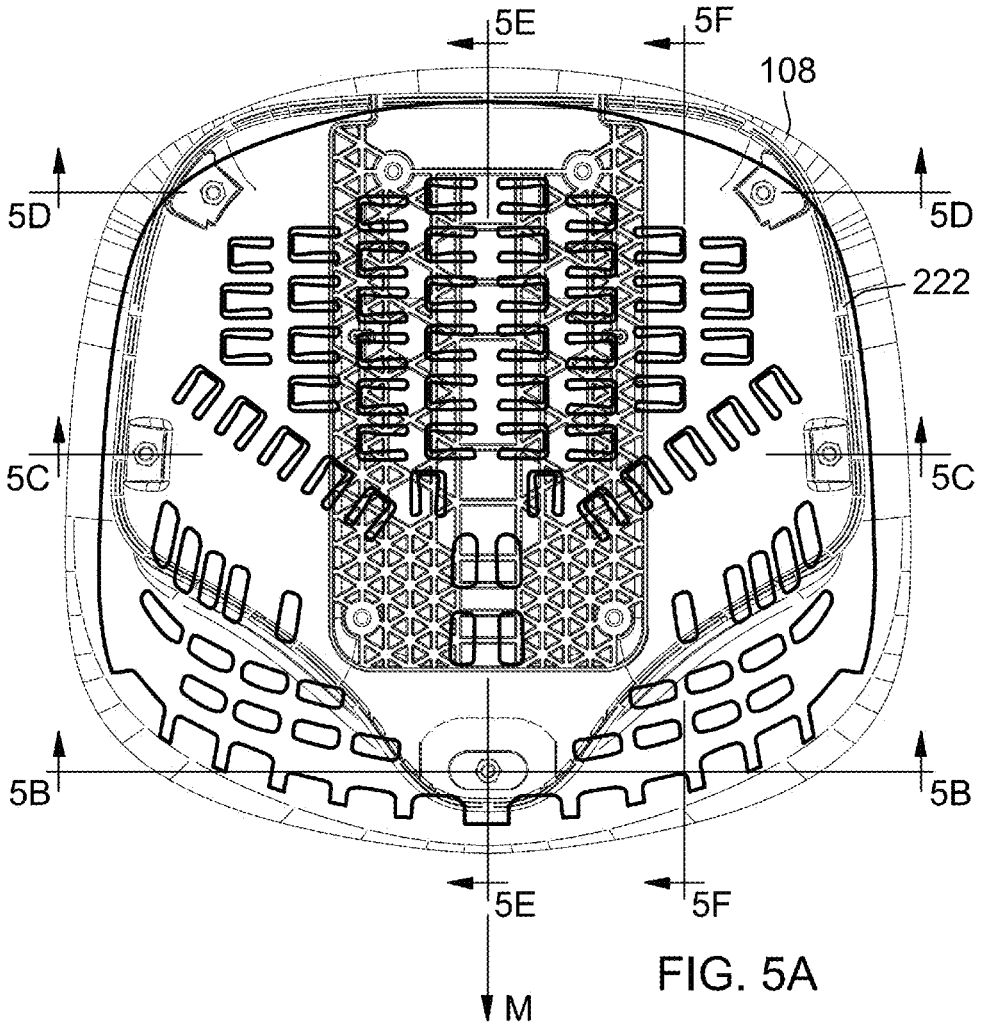
FIG. 5A is a bottom plan view of the seat support and armature.
Figure 5B:
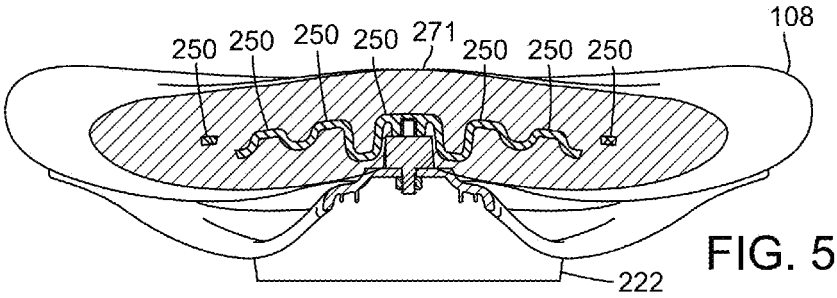
FIGS. 5B-5F are various section views in elevation taken from FIG. 5A.
Figure 5C:
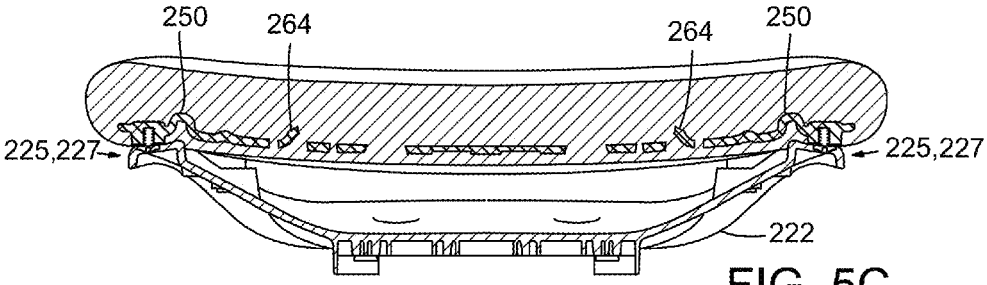
Figure 5D:
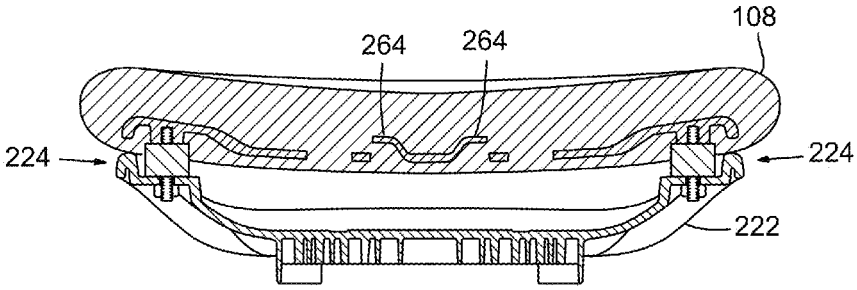

FIG. 5A is a bottom plan view of the assembled seat support 222 and the seat 108. FIG. 5B is a first section view taken laterally through the nose of the seat support 222 at the line 5B-5B in FIG. 5A and rotated so that the seat 108 is above the seat support 222 as positioned for use. As shown in FIG. 5B, at this location the pattern of the ribs 250 is more concentrated toward the pommel area along the medial axis M, with less supporting structure present in the outwardly adjacent thigh areas. In FIG. 5B, the seat has a slight bulge 271 defined at the medial axis M, which assists in preventing the user from sliding forward and provides a sense of being positively and securely seated to the user. At the location of the central section view FIG. 5C, there is more structure of the armature 240 present from left to right compared to FIG. 5B, including some of the bias elements 256 and just two of the ribs 250. As also shown in FIG. 5C, the slides 225 and ramps 227 couple the seat 108 to the seat support 222, and the upper surface is slightly concave relative to the more rearward portion of the seat 108. At the location of the rearward section view of FIG. 5D, the mounts 224 can be seen. The structure of the armature 240 is present from left to right at the location of the section view of FIG. 5D. The upper surface is slightly concave relative to the more rearward portion of the seat 108, and more toward the medial axis than at the outer edges.

Figure 5E:
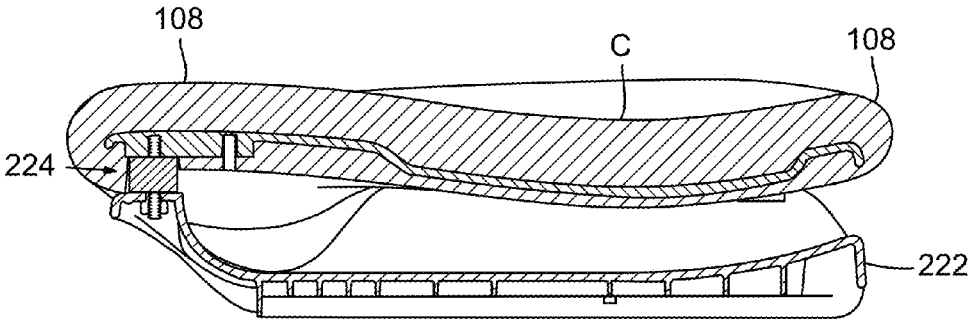
Figure 5F:
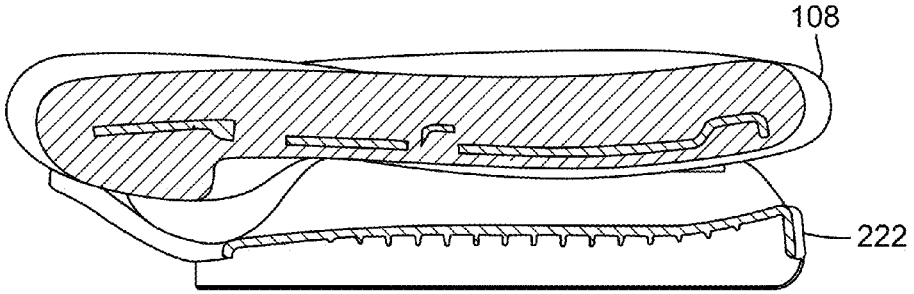

FIG. 5E is a cross section view taken longitudinally along the medial axis M. FIG. 5E shows that the armature 240 provides nearly uninterrupted support directly along the medial axis M. Also, FIG. 5E shows that a contour of the seat 108 along the medial begins at its greatest height near the front of the seat, continues along the bulge 271 and then descends to its greatest depth in a concavity C. FIG. 5F is another longitudinal cross section showing the pattern of the armature's support at a position spaced laterally from the medial axis M. The contour of the seat 108 at the position shown in FIG. 5F begins at a lower height and descends, but not to as great a depth as is shown in FIG. 5E. As seen in FIG. 5F, the support of the armature 240 is present at this position, but it is less continuous, especially in the thigh area towards the front edge of the seat 108.

In general, the seat support 222 is designed to be comparatively rigid relative to the armature 240 for the designed range of loading, but in a manner similar to the seat 108, the seat support 222 is configured to vary in stiffness and response across its surface such that it deflects by predetermined amounts at defined locations. In other words, the seat 108 and the support 222 are each flexible members (or subassemblies) having varying stiffness across their extents such that their assembly together, as assisted by the mounts 224 and slides 225/ramps 227, provides the desired magnitudes and directions of deflection (and/or rotation) under varying "user generated" loads. In one implementation, the designed range of loading is for users of 100-250 pounds in weight, with a maximum rated user load of 350 pounds.

Thus, the seat 108 is configured to deform and deflect in various ways to provide a comfortable and effective range of active seated positions for a seated user. In use, the seat 108 deforms under the weight and movements of the user, which causes its cushion 242 and its armature 240 to deform locally, with each absorbing some forces. Some areas of the seat 108 may experience sufficient remaining forces to cause the armature 240 to move relative to the seat support 222, e.g., to tilt a few degrees, by deforming one of more of the force absorbing mounts 224 and/or by causing the slides 225 to move along the ramps 227 primarily in a lateral direction, but also slightly vertically and rotationally relative to the two axes that extend generally horizontal. As described, the seat support 222 can also deflect or deform to absorb remaining forces.

Figure 9:
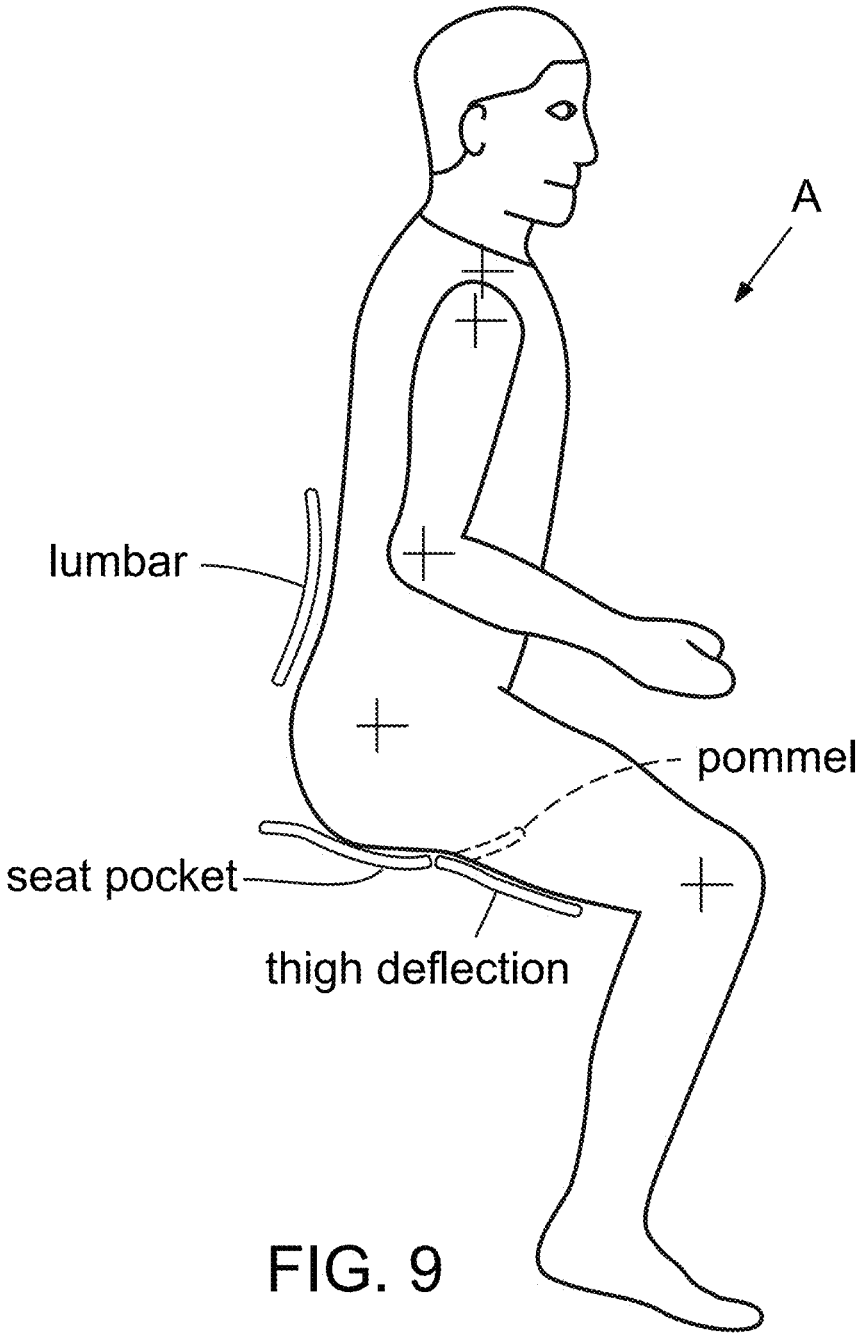
FIG. 9 is a schematic side elevation view of a male user using a stool having the new seat assembly.
Figure 10A:
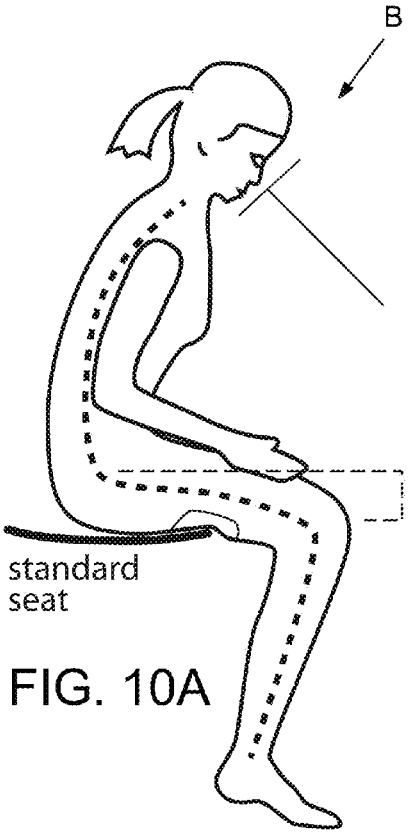
FIGS. 10A and 10B are schematic side elevation views showing a female user using a conventional stool and a stool having the new seat assembly.
Figure 10B:
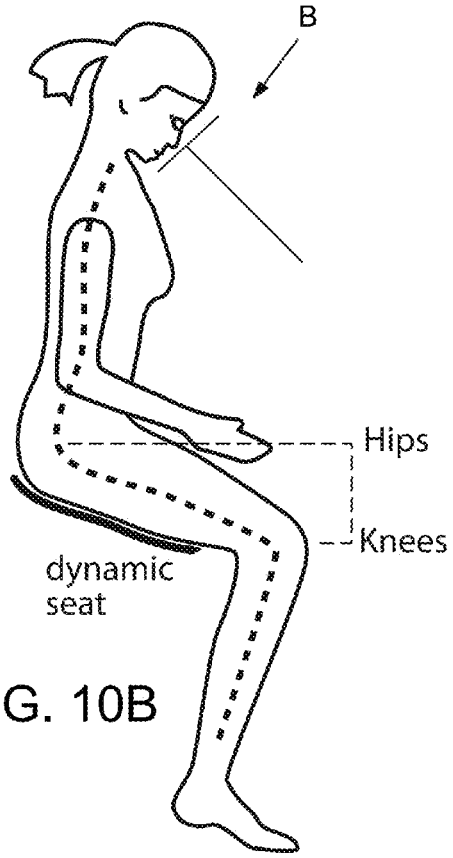

FIG. 9 is a schematic side view of a male user seated in the stool 100 in an active position with at least his toes in contact with the floor and his upper body tilted slightly forward. The position can also be described as an "active" or "athletic" position, and is sometime referred to as a "practice" position. FIGS. 10A and 10B are similar schematic side views showing a comparison of a female user's practice position while seated in a conventional stool (FIG. 10A) and the stool 100 (FIG. 10B). As shown in FIGS. 9 and 10B, the stool 100 is configured to provide an active/athletic position with one or more of the following attributes: (1) feet in contact with the floor or other support and bearing some weight; (2) thighs supported (but without impingement of femoral blood vessels); (3) sufficient support for the ischial tuberosities or "sit bones"; (4) an upright posture with a slightly forward lean of the upper body and a sufficient amount of lordosis in the lower spine (i.e. a healthy "S" shaped spinal curvature with moderate lordosis in the cervical and lumbar regions, instead of an unhealthy "C" shaped spinal curvature with kyphosis in the cervical, thoracic and lumbar regions); (5) effective vision of the oral cavity (in the case of a dental application); (6) optional lumbar support (see FIG. 9) and (7) easy ingress and egress, among others. The practice or active/athletic position shares some aspects of a so-called "saddle sitting" position, but the pommel area is much less pronounced and does not tend to force the user's legs apart to the degree experienced in the saddle sitting position.

Example

Figure 6:
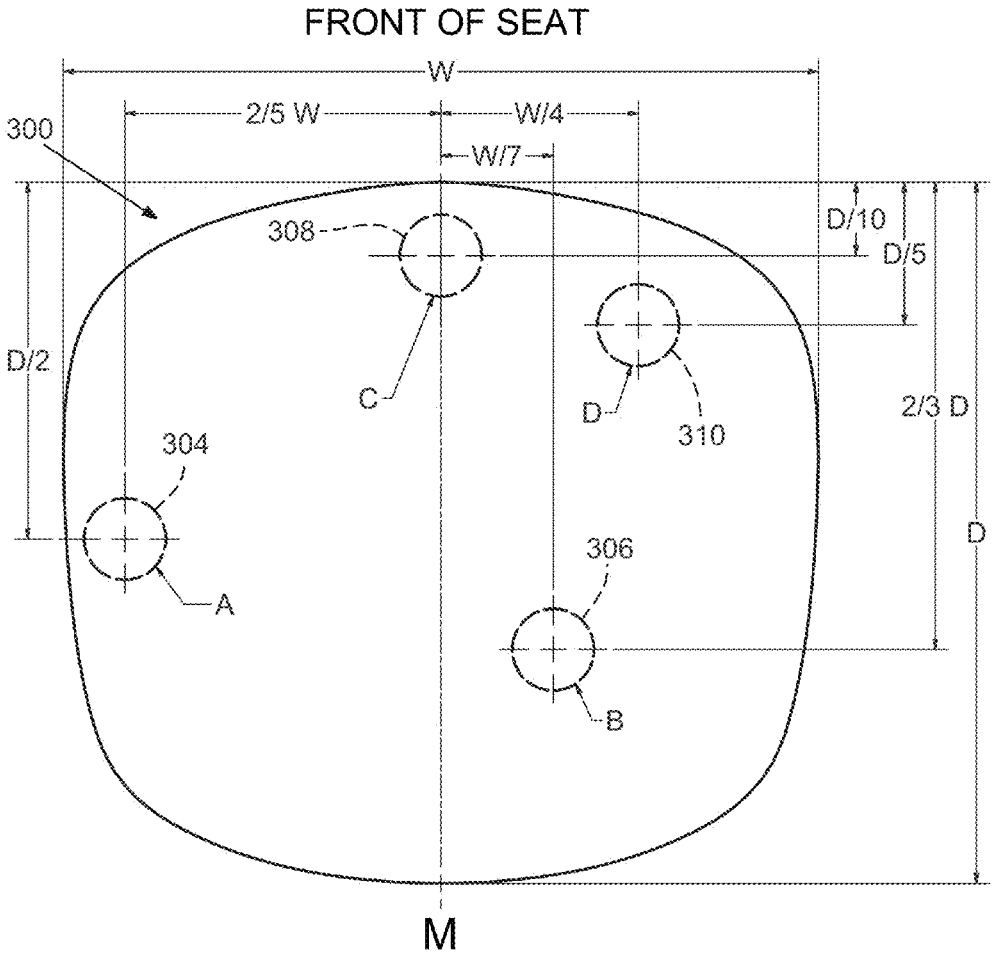
FIG. 6 is a schematic plan view of a seat configured to have different parameters at different locations on the seating surface.

In one exemplary implementation, a seat 300 as shown schematically in FIG. 6 is configured to have a predetermined pattern of varying deflection according to the location of the load on a seat surface 302. Referring to FIG. 6, a ¾" diameter cylindrical tool was used to exert a 50 lb. load upon the seat 300 (comprising a cover, a cushion and an armature to which the cushion has been over-molded) at specified locations. Representative locations A, B, C and D, (indicated in FIG. 6 by the dashed circles 304, 306, 308 and 310, respectively), are shown with coordinates based on a width W and depth D of the seat 300. For a 50 lb. load applied to location A (outer thigh area), about 19-29 mm in vertical deflection was observed, with less than about 6 mm in sympathetic response at locations B, C and D. For the same load applied at location B (rear/sit bones), vertical deflection of about 22-32 mm was observed, with less than about 6 mm sympathetic response at locations A, C and D. For the same load applied at location C (pommel area), vertical deflection of about 15-25 mm was observed, with less than about 6 mm sympathetic response at locations A, B and D. For the same load applied at location D (thigh area), vertical deflection of about 32-42 mm vertical deflection was observed with less than about 6 mm sympathetic response at locations A, B and C.

Thus, the seat 300 is most compliant in the area of location D, the thigh area near the front of the seat 300, as it exhibits the greatest deflection there. Having the greatest deflection at location D addresses the potential discomfort caused by impingement of the femoral blood vessels (see, e.g., FIG. 10A compared to FIG. 10B). In the area of location A, the outer thigh area, there is slightly less deflection than in the more central sit bone area at location B. In the area of location C, the pommel area, there is the least deflection. The relatively low sympathetic response at each location demonstrates that the locations are relatively independent of each other in response to applied loads.

Location A is directly over the slide 225 and ramp 227 coupling between the armature 240 and the seat support 222. It was observed that if greater vertical deflection is permitted at this location, then some users considered the seat 300 to feel insecure. Conversely, too little deflection at location A led to a "hot spot" and produced high pressure on users' outer thighs. The slide 225/ramp 227 coupling can be configured to provide slightly more translation and rotation than the mounts 224 and thus achieve the proper degree of deflection for location A. The slide 225/ramp 227 reduces a high pressure spot on the side of the user's thigh (i.e., point A in FIG. 6), while also allowing the armature freedom to move in a way that provides constant thigh support.

The slide 225/ramp 227 is also configured to prevent an unwanted sympathetic response under the sit bones (i.e., at point B in FIG. 5) known as the "hammocking" effect. At location B, beneath the "sit bones," too much deflection can cause "hammocking" of the seating surface and lead to undesirable side pressure on the soft tissue of the posterior and thighs. Conversely, too little deflection at location B leads to hot spots in the pressure profile, which are known to create discomfort for most users.

As stated, the deflection is lowest at location C, the pommel area, to prevent users from sliding forward or having the sensation of sliding forward. Location D is under the user's thighs and linked to the user's long-term comfort in the seat 300. As indicated, location D is configured to have the largest deflection to address possible pressure in the femoral blood vessel area.

Adjustment Assembly

The adjustment assembly 226 is positioned below the seat support 222. The adjustment assembly includes one or more manual controls, e.g., the levers (or paddles) 201, 203 and/or 205, to enable the user the control the height of the seat 108 and/or the angle or tilt of the seat 108 and back 110. For example, the leg assembly 106 that supports the seat 108 may include a gas cylinder controllable with the lever 201 to assist the user in raising or lowering the seat 108 to a desired height. As another example, the lever 203 may be configured to actuate a tilt adjust mechanism to permit the seat 108 and back 110 to be selectively angled under tension (such as when a seated occupant leans against it), to change the tension and/or to lock the seat 108 and back 110 in place and prevent any tilting. The lever 206 can be configured to permit the back 110 to be reclined relative to the seat 108.

The lower cover 230 covers a portion of the adjustment assembly 226 and is attached to the seat support 222 with fasteners 234. The rear cover 228 provides a connection to the seat back assembly 102. The rear plate 229 is fitted to the rear cover 228 by a snap-fit or other type of connection.

General Considerations

In some implementations, the armature and the seat support are formed of plastic, such as a polyester alloy. In some implementations, the cushion is formed of molded polyurethane foam and is coupled to the armature by a process known as over-molding. In one example, a synthetic faux leather cover made of polyurethane, polycarbonate and reinforced rayon fibers is applied over the cushion and at least a portion of the armature.

Commonly assigned and concurrently filed applications entitled "ARMREST ASSEMBLY AND STOOL FOR DENTAL PRACTITIONER" (U.S. patent application Ser. No. 14/639,944) and "HEIGHT ADJUSTING MECHANISM AND STOOL FOR DENTAL PRACTITIONER" (U.S. patent application Ser. No. 14/639,932) are incorporated herein by reference.

In view of the many possible embodiments to which the disclosed principles may be applied, it should be recognized that the illustrated embodiments are only preferred examples and should not be taken as limiting the scope of protection. Rather, the scope of protection is defined by the following claims. We therefore claim all that comes within the scope of these claims.

What is claimed is:

1. A seat assembly for task-oriented seated, comprising:

a seat support; and a seat coupled to the seat support and movable under load relative to the seat support, the seat having a pommel area defined at a forward side of the seat and along a medial axis of the seat, two thigh areas arranged on opposite sides of the medial axis and a cushion molded over a supporting armature with multiple bias elements, wherein the armature has a center rib positioned along a medial axis of the seat and a series of radially spaced shorter ribs on both sides of the center rib, and wherein the seat and the seat support are each configured to undergo predetermined deflections at defined locations across an extent of the seat assembly while the seat is occupied, and wherein the thigh areas are configured to deflect under less pressure than the pommel area.

2. The seat assembly of claim 1, wherein each of the thigh areas extends from the pommel area, and wherein the thigh areas are configured to deflect more than all other areas of the seat.

3. The seat assembly of claim 1, wherein the seat comprises a rear area configured to support a user's posterior, and wherein at least some of the multiple bias elements are positioned in the rear area and are individually deflectable to support the user's ischial tuberosities.

4. The seat assembly of claim 1, wherein the seat is coupled to the seat support by multiple mounts tending to at least one of absorb and isolate forces received from the seat.

5. The seat assembly of claim 4, wherein the multiple mounts comprise resilient bushing members.

6. The seat assembly of claim 5, wherein the multiple mounts comprise threaded connections to the seat and to the seat support.

7. The seat assembly of claim 1, wherein the seat is coupled to the seat support by at least one slide on the armature positioned to slidingly engage an inclined ramp on the seat support.

8. The seat assembly of claim 7, wherein the slide is positioned to move in use in at least one of a lateral direction and a vertical direction while contacting the ramp.

9. The seat assembly of claim 7, wherein the slide can rotate relative to the ramp during use along at least one of two horizontal axes that extend perpendicular to each other.

10. The seat assembly of claim 7, wherein the slide and the ramp are positioned to control deflection of the seat in an area of the user's outer thigh.

11. The stool of claim 1, wherein the seat is coupled to the seat support by at least one slide on the armature of the seat and at least one ramp on the seat support, wherein the slide is shaped for point contact, and wherein the ramp has a supporting surface extending in at least two dimensions and defining an open area along which the slide is freely movable relative to the supporting surface in response to loading of the seat and seat support.

12. A seat assembly for task-oriented seated, comprising:

a seat support;

a seat coupled to the seat support and movable under load relative to the seat support, the seat having a pommel area defined at a forward side of the seat and along a medial axis of the seat, two thigh areas arranged on opposite sides of the medial axis and a cushion molded over a supporting armature with multiple bias elements; and an adjustment assembly for mounting to a lower surface of the seat support, wherein the adjustment assembly connects the seat to a leg assembly and to a seat back assembly, wherein the seat and the seat support are each configured to undergo predetermined deflections at defined locations across an extent of the seat assembly while the seat is occupied, and wherein the thigh areas are configured to deflect under less pressure than the pommel area.

13. A stool for active task seating, comprising:

a leg assembly with multiple feet;

a seat assembly supported by the leg assembly; and a height adjustable seat back coupled to the seat assembly, wherein the seat assembly comprises a seat and a seat support, the seat comprising a pommel area defined at a forward side of the seat and along a medial axis of the seat, two thigh areas arranged on opposite sides of the medial axis adjoining the pommel area and a rear area extending across the seat and from a rear side toward the forward side, wherein the pommel area has a local peak at a higher height than the thigh areas and the rear area, and wherein the seat and the seat support are configured to deflect under load from a user by predetermined amounts at different locations over a surface of the seat, the seat being coupled to the seat support in at least an outer region of each thigh area by a slidable coupling that permits translation of the seat relative to the seat support in at least a direction transverse to the medial axis.

14. The stool of claim 13, wherein the rear area comprises multiple bias elements that are individually deflectable to support the user's ischial tuberosities.

15. The stool of claim 14, wherein the pommel area is configured to deflect less than the thigh areas and less than the rear area.

16. The stool of claim 14, wherein the seat is dynamically coupled to the seat support, and wherein the pommel area, two thigh areas and rear area are connected to each other.

17. The stool of claim 14, wherein the seat is coupled to the seat support by separate force absorbing mounts.

18. The stool of claim 13, wherein the seat comprises a cushion and an armature to which the cushion is overmolded.

19. The stool of claim 13, wherein the seat is positionable in use such that a forward side of the seat is angled downwardly.

20. The stool of claim 13, wherein the slidable coupling comprises a ramp surface shaped to slope downwardly in the transverse direction as the distance from the medial axis increases.

* * * * *